United States Patent [19]

Gemra et al.

[11] Patent Number: 4,614,399

[45] Date of Patent: Sep. 30, 1986

[54] AERIAL DROP WIRE SPLICER

[75] Inventors: Richard J. Gemra, Union; Manuel Martinez, New Providence, both of N.J.

[73] Assignee: AT&T Technologies, Inc., Berkeley Heights, N.J.

[21] Appl. No.: 633,325

[22] Filed: Jul. 23, 1984

[51] Int. Cl.[4] ..... H01R 13/502

[52] U.S. Cl. ..... 339/205; 339/97 P; 339/99 R

[58] Field of Search ..... 339/99 R, 98, 97 P, 339/97 R, 205, 96

[56] References Cited

U.S. PATENT DOCUMENTS

| | | | |
|---|---|---|---|
| 1,755,166 | 4/1930 | Cannon | 339/186 M |
| 2,725,545 | 11/1955 | Gordon | 339/99 R |
| 3,219,961 | 11/1965 | Bailey et al. | 339/91 R |
| 3,745,228 | 7/1973 | Vogt | 174/83 |
| 3,786,173 | 1/1974 | Vogt | 339/98 |
| 3,824,523 | 7/1974 | McGhee | 339/91 R |
| 3,920,305 | 11/1975 | Scott | 339/98 |
| 4,032,210 | 6/1977 | Vogt | 339/98 |
| 4,033,661 | 7/1977 | Moody et al. | 339/98 |
| 4,437,721 | 3/1984 | Kollmann et al. | 339/98 |

*Primary Examiner*—Gil Weidenfeld
*Assistant Examiner*—Thomas M. Kline
*Attorney, Agent, or Firm*—J. F. Spivak

[57] ABSTRACT

A splicing device is disclosed wherein the conductor and steel support cable portions of an aerial drop wire are each spliced utilizing a single device which is electrically insulated and weather-resistant and has a central member and end caps separable therefrom. The ends of the steel support cable are joined together by a wire linking device integrally molded in the central body and the conductors are spliced together by button-blade terminals driven into conductor-receiving cavities within the same body becoming locked in place. The risk of environmental damage is eliminated by the end caps which protect the stripped portions of the conductors, as well as by the unitary body construction of the central member which provides a sealed environment for the splices themselves.

6 Claims, 9 Drawing Figures

AERIAL DROP WIRE SPLICER

TECHNICAL FIELD

This invention relates to means for splicing together two sections of an aerial drop wire comprising a support cable and a plurality of electrical connectors.

BACKGROUND OF THE INVENTION

Aerial drop wire is a self-supporting wire for extending telephone plant from distribution cable to a subscriber in aerial applications. An exemplary drop wire comprises a plurality of insulated 22 gauge annealed copper conductors, a galvanized steel support cable, and a vinyl plastic jacket encasing the conductors and support cable in a manner that physically separates these two elements. A prior art method of splicing aerial drop wire is disclosed by AT&T Product Application Bulletin/Outside Plant—June 1977 second edition ("The Bulletin").

The Bulletin discloses that several items of hardware are required for splicing aerial drop wire. After the plastic jacket is cut so as to separate the support cable from the conductors, the support cable is then cut, stripped of its plastic jacket and rejoined using a bridge connector sold under the trademark Wirelink ®, model 5057N, as manufactured by Reliable Electric Co. of Franklin Park, Ill. Similarly, the conductors are stripped of their plastic jacket and individual insulation and then spliced together using 701-type connectors manufactured by AT&T Technologies, Inc. of New York, N.Y.

Subsequently, the conductor bundle is taped with polyethylene tape which replaces the plastic jacket as the dielectric barrier between support cable and the conductors. Next, the support cable joined by the Wirelink connector and the conductor bundle are taped together. Finally, a splicing case and sealing tape collars are introduced to encase and seal the spliced section of drop wire.

The plurality of items presently needed to splice aerial drop wire subjects the splice to the risk of damage caused by water, humidity, ice and other environmental factors. In addition, the time and labor required to construct such a splice is necessarily lengthy and expensive. The final disadvantage is that the quality of the splice is entirely dependent upon the quality of the workmanship so that the splice will be ineffective and weak if the taping, sealing or splicing are done poorly.

SUMMARY OF THE INVENTION

The disadvantages of the prior art mode of splicing aerial drop wires are obviated according to the invention in one of its aspects by providing a splicing device comprising a central body and end caps separable therefrom, and in which the ends of the support cable are linked together by a first connector in the body and the conductors are spliced by second connectors in the body so that both splices lie within and are protected by the same body.

The use of this device increases reliability of a splice by reducing labor and essentially replacing the workmanship required by the prior art. In addition, the splicing operation is converted from a long and costly process to a short and inexpensive one because no stripping or splitting is required and all of the elements necessary to effect a splicing of both support cable and conductors are included in one assembly. Finally, the risk of environmental damage may be eliminated or reduced by the described splicer device which is well adapted to provide a protected environment for the aforementioned splices.

BRIEF DESCRIPTION OF DRAWINGS

For a better understanding of the invention, reference is made to the following description of an exemplary embodiment thereof, and to the accompanying drawings wherein.

DESCRIPTION OF EMBODIMENT

Figure 1:
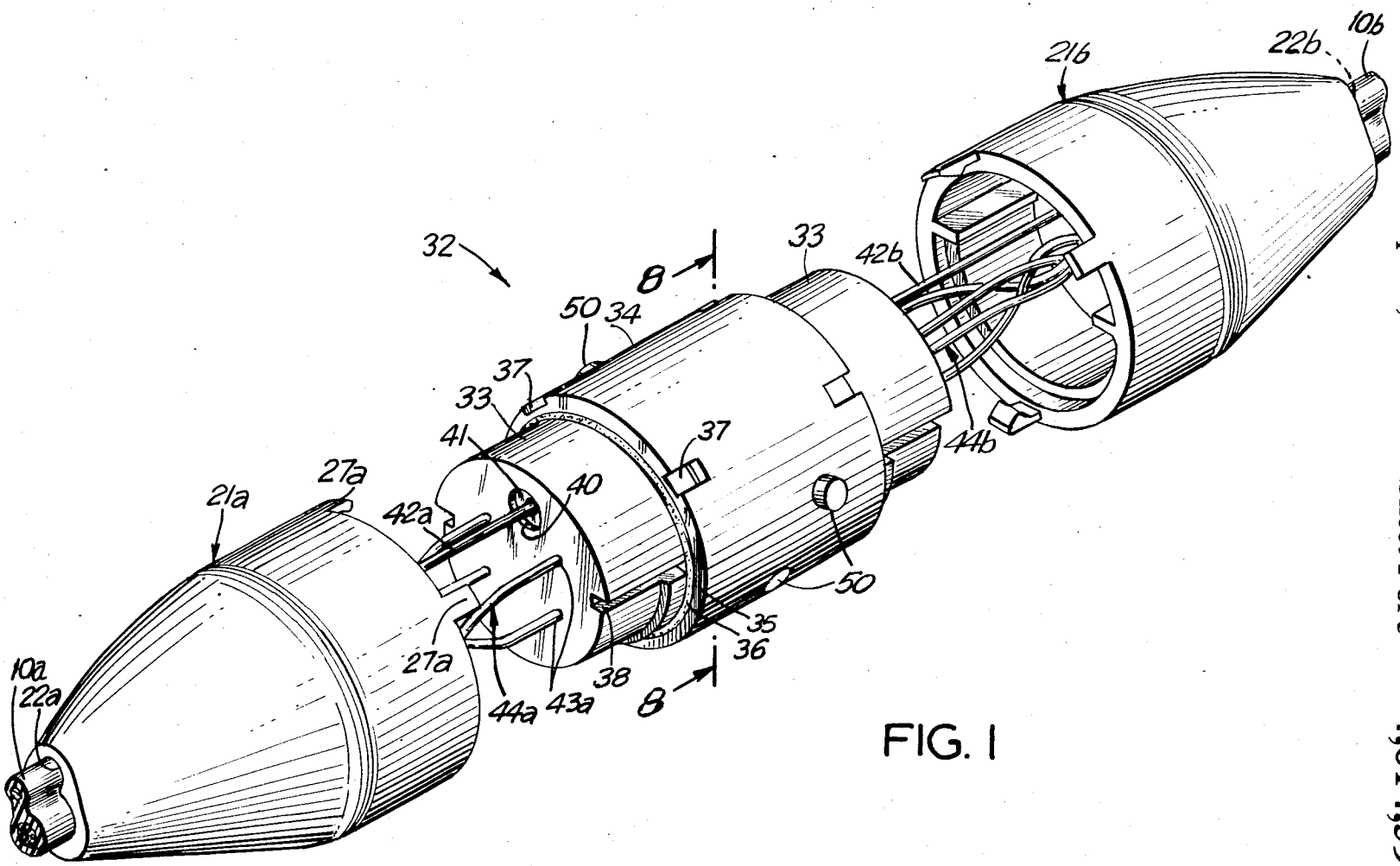
FIG. 1 is an isometric view of the exemplary splicer.
Figure 2:
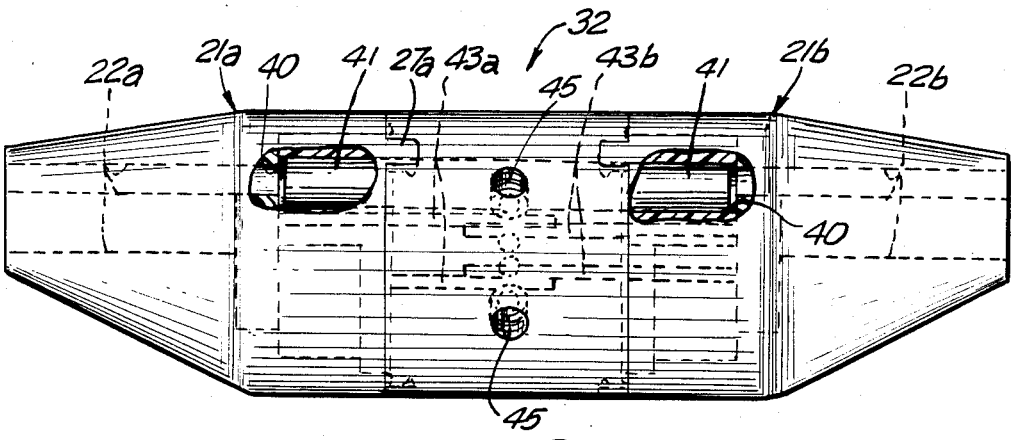
FIG. 2 is a front elevation view of the splicer in FIG. 1.

Referring to FIGS. 1–2, the splicing device comprises insulative housing means in the particular form of a central body 32 and end caps 21*a*, 21*b* having lengthwise apertures 22*a*, 22*b* therein for passage therethrough of the aerial drop wire sections 10*a*, 10*b*. Both body 32 and end caps 21*a*, 21*b* are adaptable for production using plastic molding and are constituted of a weather-resistant, electrically insulated material as for example nylon.

Figure 4:
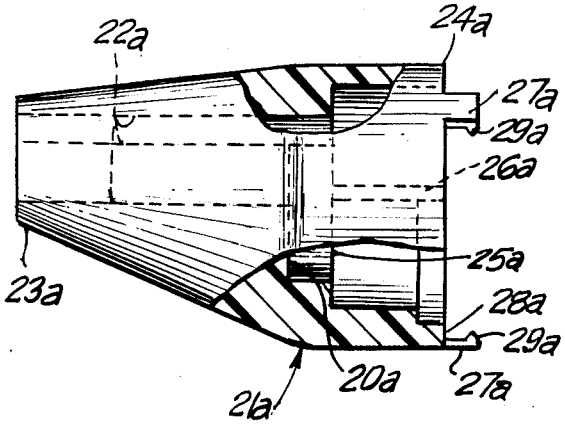
FIG. 4 is an enlarged front elevation view, partially in cross-section, of an end cap of the FIG. 1 splicer.
Figure 5:
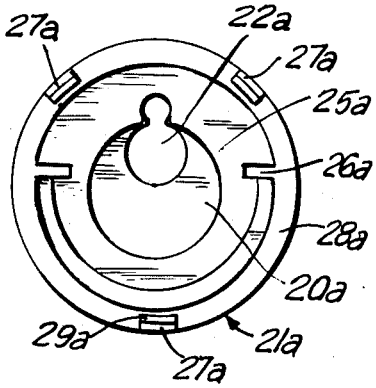
FIG. 5 is an enlarged end view of the FIG. 4 end cap.

FIGS. 1, 2, 4 and 5 show end caps 21*a*, 21*b* to be substantially conical elements but it is apparent that they could have other shapes. FIGS. 4 and 5 illustrate the details that are typical for both end caps. Except for aperture 22*a*, end cap 21*a* is solid at its outer end portion 23*a*. At its inner end portion 24*a*, end cap 21*a* is no longer solid but has formed within it a hollowed-out space, such space having a smaller region extending from a first back wall 20*a* approximately midway within end cap 21*a* to a second back wall 25*a* and a larger region extending from the second back wall 25*a* to the inner end face 28*a* of end portion 24*a*. Aperture 22*a*, which is shaped to receive therein drop wire section 10*a* at the end portion 23*a* and to have the same cross-sectional shape as such section, thus extends lengthwise through end cap 21*a* and, at inner end portion 24*a*, expands into the aforementioned hollowed-out space.

Within the hollowed-out space, at least two integral ribs 26*a* run axial along the inside wall of end cap 21*a* starting from second back wall 25*a* to the face of end portion 24*a*. At the face of end portion 24*a*, there also exists a plurality of tabs 27*a* that project out axial from end cap 21*a*. Tabs 27*a* are integral extensions of the inner end face 28*a*, and they have front hook-like portions 29*a* which protrude radially inward.

In the embodiment illustrated in FIG. 1, central body 32 is cylindrically shaped with its end sections 33 being of slightly smaller radial dimension than its middle section 34 such that middle section 34 appears as a radially enlarged part of body 32. O-rings 36 which are circular bands of a weather-resistant, elastomeric material are fitted around end section 33 abutting the annular shoulders 35 at the end of middle section 34. End sections 33 are of the same shape but slightly smaller diameter as the aforementioned hollow-out regions bounded by back walls 25*a*, 25*b* and end faces 28*a*, 28*b* which are formed within end caps 21*a*, 21*b*, respectively, thus allowing said end caps to fit over those end sections onto body 32.

At shoulders 35, a plurality of notches 37 are formed in middle section 34, notches 37 being shaped to receive tabs 27*a* and the hook portions 29*a* thereof. In addition, body 32 has formed therein a plurality of slots 38 axially extending from the outer faces of ends 33 to shoulders 35 and shaped to receive therein ribs 26*a*. The notches 37 and slots 38 enable end caps 21*a*, 21*b* to lock onto central body 32 when said end caps are placed over end sections 33.

Figure 3:
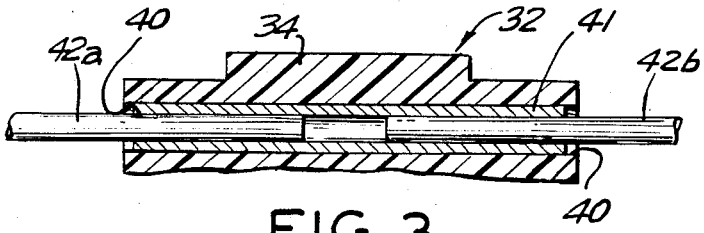
FIG. 3 is an enlarged cross-sectional view of the longitudinal aperture and embedded mechanical connector of the splicer of FIG. 1 with support cable sections inserted therein.

Referring to FIGS. 1–3, body 32 has a lengthwise aperture 40 therein in which is received a mechanical connector 41, sold under the trademark Wirelink, integrally molded into body 32 to be in affixed relation therewith. Connector 41 is manufactured by Reliable Electric Co. of Franklin Park, Ill. and is a device that can link sections of wire or cable in situations where said cable is brought under sufficient tension to keep the jaws of the connector locked, such as at a splice within a span for aerial drop wire. In FIG. 3, the free ends 42*a*, 42*b* of the support cable are shown as being joined via connector 41.

Figure 9:
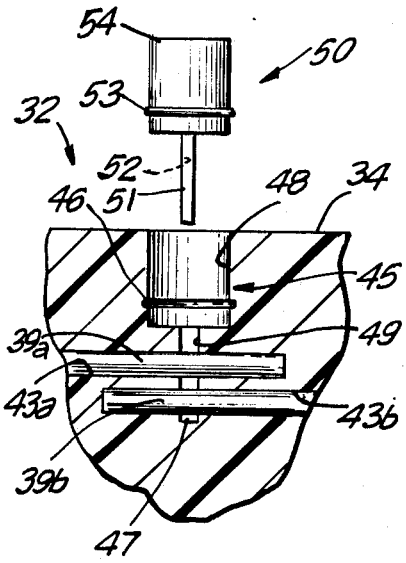
FIG. 9 is a longitudinal cross-section of a portion of the FIG. 1 splicer, such cross-section showing an individual body cavity of such splicer.

FIGS. 1–2 show that body 32 also has formed therein a plurality of guide holes 43 which extend longitudinally inward from the outer faces of end sections 33 to points only slightly farther than midway through said body. Analogous to aperture 40 which has a diameter formed to accept with a slide of loose fit the support cable ends 42*a*, 42*b*, guide holes 43*a*, 43*b* are sized to accept with a slide or loose fit the conductor sections 44*a*, 44*b*. Guide holes 43*a*, 43*b* are holes which are in radially spaced relation along a common redius for body 32 with inner guide hole portions 39*a*, 39*b* intersecting and continuing through cavities 45 which extend radially into body 32 from its outer surface. As seen in FIGS. 2 and 9, guide holes 43*a* are paired with guide holes 43*b* so that an individual pair extends through a single cavity 45, the two holes of each pair travelling in opposite longitudinal directions, in a manner that positions one guide hole in radially displaced relation with the other within the cavity region such that the holes' inner portions 39*a*, 39*b* longitudinally overlap.

Figure 6:
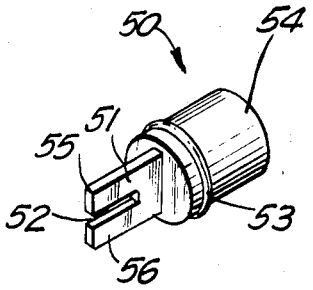
FIG. 6 is an isometric view of a button-blade terminal element of the FIG. 1 splicer.
Figure 7:
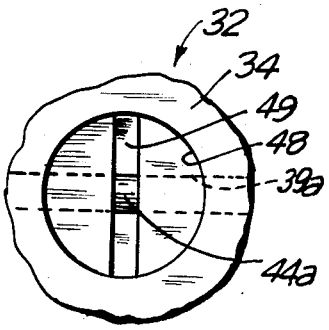
FIG. 7 is a top view of a central body cavity of the FIG. 1 splicer without the FIG. 6 element inserted therein.
Figure 8:
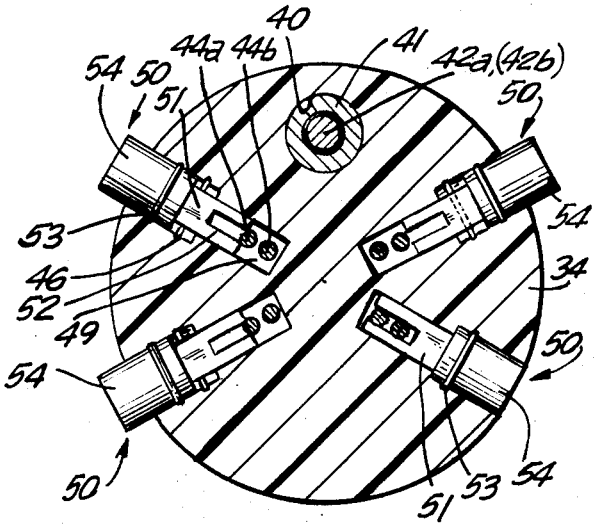
FIG. 8 is a cross-sectional view of the FIG. 1 splicer taken along arrows 8—8 in FIG. 1, showing central body cavities formed in the central body of the splicer and having inserted button-blade terminal elements including the FIG. 6 element.

FIGS. 8 and 9 show that cavities 45 are divided into outer and inner parts 48, 49. The outer part 48 of each cavity 45 is cylindrical. The inner part 49, as illustrated in FIG. 7, is a slot of rectantular cross-section, both dimensions of the rectangle being smaller than the diameter of outer part 48 and with the larger dimension of the rectangle being normal to guide hole portions 39*a*, 39*b*. The cavities 45 are spaced around the periphery of middle section 34 and they extend radially into body 32 so that inner slots 49 intersect with guide hole portions 39*a*, 39*b* at a perpendicular angle and so that slots 49 terminate at cavity bottom 47 disposed radially inward of said guide holes. Each cavity 45 is formed to receive therein a button-blade terminal 50 (FIG. 6). Cavities 45 are further characterized by having, in the top half of each at least one annular groove 46 formed in and extending around the cylindrical wall surface of the cavity.

Each of the aforementioned cavities 45 has inserted therein a button-blade terminal 50 (FIG. 6) having at its rear a solid cylindrical plunger 54 which will be flush with body 32 once terminal 50 is fully inserted into cavity 45. Molded into plunger 54 to project outward from its front is a two-line terminal 51 of which the two tines 55, 56 are spaced by a gap 52 and having respective cutting edges on the sides of those tines toward such gap. Plunger 54, which is made of a material similar to body 32 and end caps 21*a*, 21*b*, has formed on its surface at least one convex annular ridge 53 which is shaped to fit into the concave annular groove 46 situated in a cavity 45, enabling button 50 to lock by a snap-fit into cavity 45 once the button is inserted therein. The maximum diameter of ridge 53 is slightly greater than the diameter of cavity 45 so that moderate force must be used to drive plunger 54 entirely into outer part 48 of cavity 45. When this is done, the bifurcated blade terminal 51 is driven into inner slot portion 49 of cavity 45 to be received therein with a close fit.

DESCRIPTION OF USAGE OF EMBODIMENT

In the use of the splicing device, central body 32 and end caps 21*a*, 21*b* are initially separated farther apart than is shown in FIG. 1. The drop wire sections 10*a*, 10*b* are passed through apertures 22*a*, 22*b* in said end caps from outer end portions 23*a*, 23*b* to inner end portions 24*a*, 24*b* so as to project out beyond said end caps towards body 32. End caps 21*a*, 21*b* are pre-filled with an encapsulant, which may be for an encapsulant identified as model number KM-2547 manufactured by Solar Compounds, Inc. of Linden, N.J. The proprietary formulation has weather-resistant and waterproof properties and will not expand or contract due to environmental changes.

The plastic jackets of drop wire sections 10*a*, 10*b* are then cut at the free ends of the sections so as to separate the support cable from the conductors. After the support cable is stripped at its ends of its plastic jacket, the free ends 42*a*, 42*b* are passed into opposite ends of aperture 40 in body 32. Free ends 42*a*, 42*b* become linked by the mechanical connector 41 which is integrally molded into central body 32.

Conductor sections 44*a*, 44*b* of the two drop wire sections 10*a*, 10*b* are first stripped of their plastic jacket, but not their insulation, before being fed into the openings of their respective guide holes 43*a*, 43*b* which are located at the end faces of the opposite end sections 33 of body 32. Said conductors are color-coded so that a matched color-coded pair will be fed into a guide hole pair that extends into the same cavity 45.

Next, end caps 21*a*, 21*b* are assembled onto end sections 33 of central body 32 in such a manner that ribs 26*a*, 26*b*, and tabs 27*a*, 27*b* fit into slots 38 and notches 37 which have been shaped to receive therein said members of said end caps. The hollowed-out regions within said end caps bounded by first wall 20*a* and second wall 25*a* will accommodate any excess length of said conductors which would tend to bunch up and prevent secure assembly. Of particular importance is that slots 38 function as an anti-rotation feature such that once ribs 26*a*, 26*b* are inserted therein the end caps 21*a*, 21*b* and central body 32 move in fixed relation with each other. This reduces the risk that the splices of the support cable and the conductors will be loosened due to any jostling of the splicing device itself. Note also the snap-fit interlocking of tabs 27*a*, 27*b* and their hooks 29*a*, 29*b*. It is this feature which locks end caps 21*a*, 21*b* onto body 32 and thus holds said end caps from separating therefrom.

Once end caps 21*a*, 21*b* are securely assembled onto body 32, a sealed environment is established for conductors 44*a*, 44*b* which were stripped of their jacketing and left unprotected. Neither water, humidity nor ice can penetrate via apertures 22*a*, 22*b* because of the weather-resistant encapsulant within said end caps as well as the structure of said apertures which has only the barest of clearances with drop wire sections 10*a*, 10*b* once they are passed through those apertures. Additionally, O-ring 36 become packed in between end caps 21*a*, 21*b* and shoulders 35 forming fluid-tight seals or gaskets for the joint areas of the device.

As seen in FIGS. 2, 8 and 9, the feeding of the conductor sections 44*a*, 44*b* into their respective axial guide holes 43*a*, 43*b* causes portions of those sections to be positioned within the cavities 45 which run radially inward toward the center of section 34 of body 32. After that positioning has occurred, the respective buttons 50 in said cavities are driven radially inward by means of a hammer or similar instrument. Such driving inward of each said button causes the conductor sections 44*a*, 44*b* in cavities 45 to be forced into the gaps 52 of each button terminal 51 such that the cutting edges of tines 55, 56 of those terminals pierce the insulation of the conductors 44*a*, 44*b*. As a result, each pair of conductors 44*a*, 44*b* become electrically coupled together (i.e., "spliced").

It should be noted that inner slot part 49 of each cavity 45 serves three functions. First, it acts as an alignment device insuring that each button 50 is inserted properly, that is, blade terminal 51 will be perpendicular to guide hole portions 39*a*, 39*b* so that conductor sections 44*a*, 44*b* in a cavity 45 will necessarily be forced into gaps 52 of said terminal. Secondly, said inner slot, by securely maintaining button 50 in a set position, guards against any subsequent shifting or rotating of tines 55, 56 caused by outside forces and thus prevents loosening of the splice connections and cracking of said tines. Finally, inner slot part 49 is arranged together with guide hole portions 39*a*, 39*b* in such a manner to cleanly cut through the insulation of conductor sections 44*a*, 44*b* and produce the most effective splicing possible. Guide hole portions 39*a*, 39*b*, which snugly contain conductors 44*a*, 44*b*, span across inner slot 49. FIG. 7 shows that terminal 51, which is adapted to drive into said slot, is only exposed to a section of the length of said conductors, such section equal to the smaller dimension of said slot. Upon contact with tines 55, 56 of terminal 51, said section responds as if taut because said conductors' ability to bend and flex away from such contact is prevented by the narrow channels of slot 49 and guide hole portions 39*a*, 39*b*. If said slot had a wider cross-sectional area, the free ends of said conductors could slip out of their respective guide holes into said slot when terminal 51 made contact and, alternatively, if said guide holes had larger diameter, said conductors contained therein would bend causing the aforementioned exposed sections to be less than taut when terminal 51 contacts, said terminal ripping into its insulation rather than cleanly slicing through it.

When buttons 50 are fully driven into cavities 45, the convex ridges 53 of such buttons snap into the concave grooves 46 of each of the respective cavities to lock said buttons into said cavities so as to permanently maintain the splices of the conductor pairs. Moreover, the press fit of ridges 53 into grooves 46 provides between buttons 50 and body 32 a seal inhibiting moisture from penetrating into cavities 45 beyond groove 46. The cavities 45 are also pre-filled with the same aforementioned encapsulant as end caps 21*a*, 21*b*. It is in these two ways that said cavities become sealed thus isolating the splices from any damaging weather or climate.

What is claimed is:

1. A splicing device for electrical conductors comprising:

(a) an insulative central body having formed therein a plurality of conductor-receiving guide holes adapted to receive therein electrical conductors, said guide holes extending from opposing ends of said central body inwardly and lengthwise through said central body, in radially spaced relation along a common radius of said body, reaching into and continuing through cavities which extend radially into said body from its outer surface transverse to the axis of said guide holes such that a pair of guide holes, one from each end of said body, extend through a single cavity in a manner that positions one guide hole in radially spaced relation from the other guide hole, each cavity being formed to receive therein means for splicing said conductors in said cavity, said means comprising a button-blade terminal having an insulative body with a two-tine electrically conductive terminal blade at its front, the tines being spaced by a gap and having respective cutting edges on their interior sides, each button-blade terminal having formed on the surface of its insulative body, a convex ridge shaped to fit into a concave recess on the wall of each cavity and enabling said buttons to self-lock into said cavity when inserted therein; and (b) a pair of spaced insulative end caps having apertures therein for passage therethrough of said conductors and a plurality of mating locking means on said end caps adapted to engage opposite ends of said central body so as to be secured thereto, said end caps being provided with a hollowed-out region for accommodating excess lengths of conductor which may be present during assembly of the device, and wherein said splicing means are insertable in said central body subsequent to securing said end caps to said body.

2. The splicing device of claim 1 wherein each said cavity is divided into outer and inner regions, said outer region being shaped to receive therein the body of a said button-blade terminal and said inner region which accommodates only the two tine terminal, such that said terminal perpendicularly intersects said guide holes, and which terminates at a cavity bottom disposed radially inward of said guide holes.

3. The splicing device of claim 2 wherein said cavities are pre-filled with encapsulant.

4. A splicing device for arial drop wire comprising:

(a) an insulative central body having formed therein a plurality of paired conductor-receiving guide holes which are adapted to receive therein electrical conductors of separate sections of said drop wire and lengthwise first apertures adapted to receive therein support cables of said separate drop-wire sections, wherein said paired guide holes extend lengthwise through said central body in radially spaced relation along a common radius of said body, each guide hole from a pair of guide holes extending into said body from opposite ends thereof such that said pair of guide holes, one from each end of said body extend through a single cavity in said body in a manner that positions one guide hole in radially spaced relation from the other guide hole of the pair;

(b) a pair of spaced insulative end caps having second apertures therein for passage therethrough of said separate drop wire sections and adapted to engage said central body via mating engaging means on said end caps and said central body as to be secured thereto; and (c) means for splicing said drop wire, said conductors of said separate sections splicable by means located within each cavity within said central body and insertable therein subsequent to securing said end caps to said body, said means comprising a button-blade terminal having an insulative body and a two-tine electrically conductive terminal blade at its front, the tines being spaced by a gap and having respective cutting edges on their interior sides, said button-blade terminal having formed on its insulative body surface a convex ridge which is shaped to fit into a concave recess on the wall of each respective cavity and enabling said buttons to self-lock into such cavity when inserted therein and said support cables of said separate sections being splicable by means of a mechanical connector integrally molded within said first apertures.

5. The splicing device of claim 4 wherein each said cavity is divided into outer and inner regions, said outer region being shaped to receive therein the body of a said button-blade terminal and said inner region which accommodates only the two tine terminal, such that said terminal perpendicularly intersects said guide holes, and which terminates at a cavity bottom disposed radially inward of said guide holes.

6. The splicing device of claim 5 wherein said cavities are pre-filled with an encapsulant.

* * * * *